United States Patent [19]

Snowden

[11] 4,229,897

[45] Oct. 28, 1980

[54] MUZZLE LOADING APPARATUS

[76] Inventor: Jimmy C. Snowden, 72 Western Dr., Pine Bluff, Ark. 71602

[21] Appl. No.: 953,891

[22] Filed: Oct. 17, 1978

[51] Int. Cl.[3] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 3,747,252 | 7/1973 | Walker | 42/90 |
| 4,050,175 | 9/1977 | Mulinex | 42/90 |
| 4,094,098 | 6/1978 | Gourley | 42/90 |
| 4,112,606 | 9/1978 | Griffin | 42/90 |
| 4,152,858 | 5/1979 | Dobbs | 42/90 |

*Primary Examiner*—Charles T. Jordan

*Attorney, Agent, or Firm*—Clarence A. O'Brien; Harvey B. Jacobson

[57] ABSTRACT

Apparatus for rapid loading of a muzzle loaded rifle with a ball and a premeasured quantity of powder. With use of the device, the powder charge and ball of the muzzle loaded rifle are charged simultaneously and the ball is seated in the rifle barrel. A holder for the percussion cap is provided to ensure ready accessibility under field conditions. The device can be adapted to any muzzle loading rifle of any caliber and is relatively portable, simple and reliable in construction and use, having particular utility in hunting of game.

10 Claims, 5 Drawing Figures

MUZZLE LOADING APPARATUS

BACKGROUND OF THE INVENTION

1. Field of the Invention

The invention relates an accessory for use with a muzzle loaded firearm. More particularly, the invention relates to a charging device for holding all necessary firing components and simultaneously inserting in a muzzle loading rifle of any size and caliber a premeasured powder charge and ball rapidly and expeditiously and then seating the ball.

2. Description of the Prior Art

Various structures are known in the prior art for facilitating muzzle loading as well as shell loading. For example, U.S. Pat. No. 108,359, issued Oct. 18, 1870, to Kahn, discloses a powder holding device to measure the charge and regulate the quantity of powder for guns, rifles, pistols, and other weapons of a similar nature. U.S. Pat. No. 11,174, issued June 27, 1854, to Peavey, discloses a cylinder with several chambers, one of which fits on a muzzle of a barrel, and can discharge a bullet and loose powder into the muzzle of the barrel. The device is complicated by the plurality of moving parts, the necessity for adjustment, and has the drawback of bulkiness as well as difficulty of assembly and operation under field hunting conditions. U.S. Pat. No. 2,809,550, issued Oct. 15, 1957, to Lange, and U.S. Pat. No. 2,854,881, issued Oct. 7, 1958, to Craft, show devices for loading shotgun shells, making no disclosure of utility for muzzle loading rifles. U.S. Pat. No. 183,902, issued Oct. 31, 1876, to Camp, also relates to loading of shotgun cartridges, rather than loading of a firearm itself through the barrel.

A problem associated with use of muzzle loading rifles in game hunting is the time required to reload under actual field conditions of use. A period typically of one to two minutes is required to assemble all the necessary items carried by the hunter and all components are individually inserted in the muzzle for charging with a ramrod for reloading. Moreover, certain prior art devices to facilitate the loading are not easily adaptable to muzzle loading rifles having barrels varying in shape and size. Typically, the caliber of muzzle loading rifles can vary through the range of 36 to 58 caliber.

SUMMARY OF THE INVENTION

The invention overcomes drawbacks in conventional techniques for loading muzzle loaded rifles by providing a device which holds all necessary items, the device being easily fitted to the barrel of the muzzle loaded rifle for deposition therein of a premeasured charge of powder, and a ball. A component of the device provides a receptacle for holding a percusion cap for ready access as needed. With use of the device, reloading can be accomplished typically in a matter of a few seconds, reducing the time required under actual field hunting conditions to reload the muzzle loaded rifle after discharge of the rifle. Since the success of the hunter in striking game can depend upon rapid repetition of a shot which misses the game, the present invention can contribute materially to the success of a sportsman or hunter by permitting reloading and refiring before the game has escaped.

It is accordingly a primary object of the present invention to permit reloading of a muzzle loaded rifle quickly and expeditiously under field usuage conditions.

Another object of the invention is to permit storage of a premeasured quantity of black powder, a ball of appropriate size corresponding to the caliber of the rifle, a ball starter and percussion cap for rapid loading into the barrel of the rifle when needed.

Yet another object of the invention is to provide a muzzle loaded rifle loading device adaptable to fit the muzzle of muzzle loaded rifles having different barrel shapes and different calibers.

Still another object of the invention is to promote hunting safety through minimizing risks associated with carrying a rifle charge under hunting conditions and the risk of accidental detonation with conventional reloading, particularly under hurried field conditions.

A further object of the invention is to provide a muzzle loaded rifle loading device which is relatively simple in construction, economically manufactured from common materials and tools, conveniently carried under actual field conditions, and operable repeatedly with little required maintenance.

Another further object of the invention is to provide a receptacle for holding a percussion cap to give the hunter dependable and ready access to a cap as needed under field conditions.

These and other objects are achieved through use of a loader device comprising a plunger assembly and a mounting and loading assembly. The plunger assembly comprises an elongated plunger housing in two sections with a longitudinal bore for receiving the powder, ball and starter, along with a plunger which can be pushed by a handle slidingly through the bore to load the ball and premeasured charge of black powder into the barrel of the muzzle loaded rifle. The mounting and loading assembly is attached to the plunger assembly and is provided with a recess for fitting over the barrel of the upright muzzle loaded rifle so as to orient the plunger assembly bore directly over the muzzle of the rifle barrel. The mounting and loading assembly is provided with a metal slide cover strip to prevent communication between the plunger assembly bore and the rifle bore until loading is to be accomplished. Means are provided for retaining a percussion cap in a leather extension attached to the body of the mounting and loading assembly.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
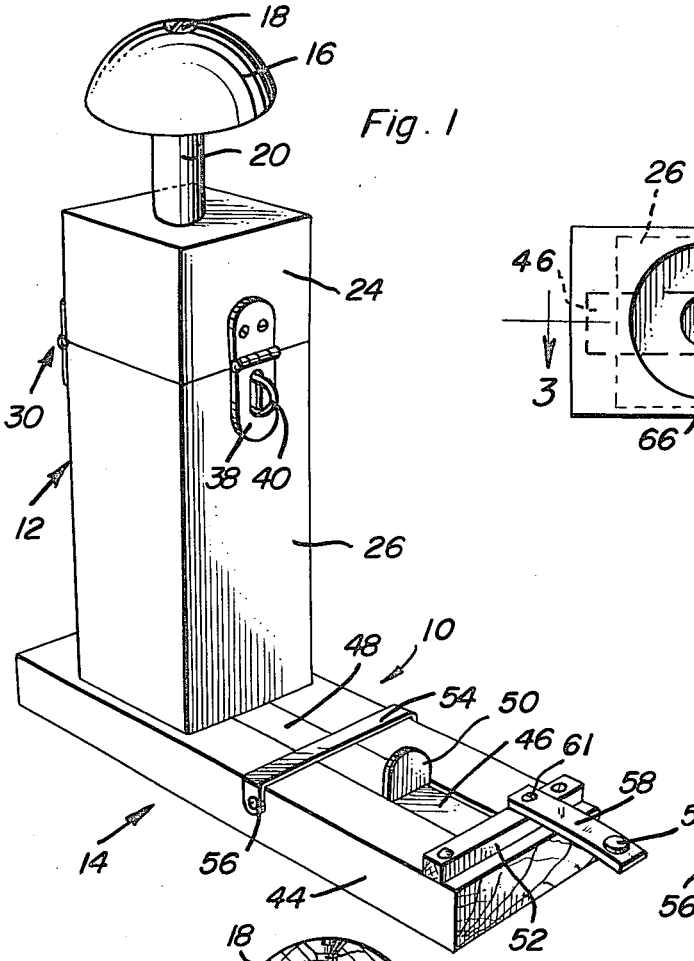
FIG. 1 is a perspective view of the muzzle loading device of the present invention, showing the device charged and prepared for attachment to a muzzle loaded rifle and loading thereof.
Figure 3:
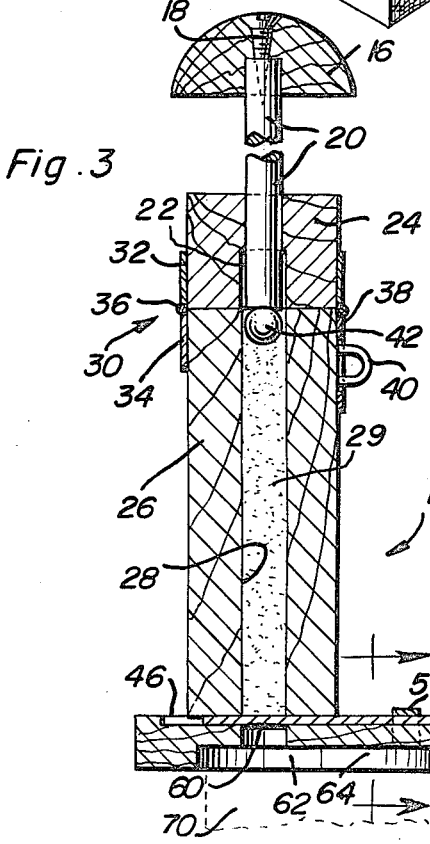
FIG. 3 is a sectional view of the device of FIG. 2, taken substantially upon a plane passing along section line 3—3 on FIG. 2.

In FIGS. 1 and 3, the muzzle loading device 10 is shown, consisting of plunger assembly 12 and mounting and loading assembly 14. Plunger assembly 12 is made up of wooden handle 16, fastened by flathead wood screw 18 to plunger 20, which is in the form of a wood dowel. Plunger 20 fits within bore 22 of upper plunger housing 24, which is of somewhat narrower diameter in the upper portion of upper plunger housing 24 than in the lower portion thereof. Also making up plunger assembly 12 is lower plunger housing 26, which is an elongated block having a longitudinal bore 28 in registry with bore 22 of upper plunger housing 24. Upper plunger housing 24 is attached to lower plunger housing 26 by hinge 30, made up of upper flange 32, lower flange 34 and hinge pin 36 for pivotal movement of upper plunger housing 24 when plunger 20 is retracted to its upward position, such as in FIG. 3. When in the open position, as shown in the left portion of FIG. 5, loading of a premeasured quantity of black powder 29, along with a ball 42, can be made into longitudinal bore 28. Upper plunger housing 24 can then be pivoted on hinge 30 to the closed position shown in FIG. 3, and hinge type hasp 38 can be secured over staple 40 which is mounted on lower plunger housing 26. When so secured, plunger 20 can be forced downwardly by pressure on handle 16, thereby forcing ball 42 and associated powder charge into the lower portion of bore 28 for retention until loading in the barrel of a muzzle loaded rifle is to be carried out.

Figure 2:
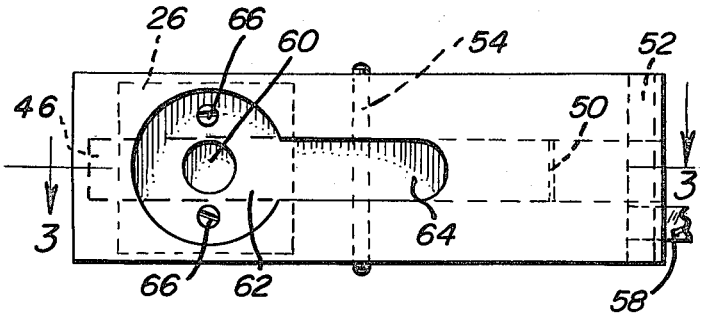
FIG. 2 is a bottom plan view of the loading device of FIG. 1.
Figure 4:
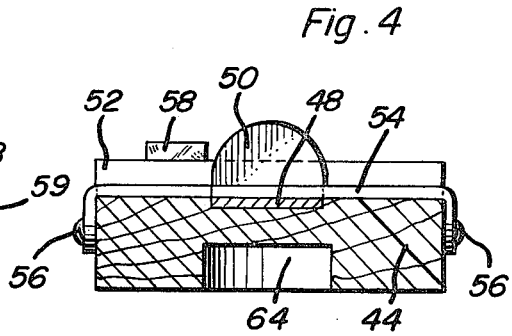
FIG. 4 is a transverse sectional view of the mounting and loading assembly, taken substantially upon a plane passing along section line 4—4 of FIG. 3.

Referring again to FIG. 1, mounting and loading assembly 14 consists of wooden platform 44, having a trough 46, trough 46 being fitted with slide cover strip 48, which slides along the length of trough 46. Slide cover strip 48 has upstanding gripping tab 50 for manual adjustment of its position within trough 46. Backstop 52 is provided to retain slide cover strip 48 in trough 46, along with retaining bar 54, which is attached by wood screws 56 to the lateral surfaces of platform 44. Plunger assembly 12 is attached by any suitable means to mounting and loading assembly 14, such as by a suitable adhesive, by screws 66, as shown in FIG. 2, staples, nails, or the like. Leather extension 58 is attached by wood screw 61 to backstop 52, and is provided with a hole of the proper size for receiving percussion cap 59, held in frictional engagement with such hole.

FIG. 2 best shows the recess 62 on the lower surface of platform 44 for mounting on a muzzle loaded rifle. Platform bore 60 is centered in circular recess 62, which recess has a diameter sufficient to accommodate the barrel of the particular muzzle loaded rifle contemplated for use with device 10, and recess 62 has a cut out portion to accommodate a rifle sight near the end of the barrel of the rifle. Accordingly, channel 64 of recess 62 is provided to accommodate the forward sight on the rifle barrel. Platform 44 is mounted on lower plunger housing 26 by wood screws 66, which are applied through recess 62 but at a location which does not pass through trough 46 in platform 44.

In FIG. 3, tab 50 is shown in the position in which communication is blocked by slide cover strip 48 between longitudinal bore 28 and platform bore 60, such is the position of tab 50 when loading of the device is carried out. When the contents of bore 28 are to be discharged through platform bore 60 and into the barrel of muzzle loaded rifle to which device 10 is attached, tab 50 is manually moved to the position shown in phantom, designated by the numeral 50' in FIG. 3. In such a position, communication between bore 28 and platform bore 60 is opened and downward extension of plunger 20 forces the charge of powder 29 and ball 42 into barrel 70 of the muzzle loaded rifle. This loading operation is best shown in the right representation of FIG. 5, where slide cover strip 48 is retracted fully and plunger 20 is depressed downwardly to load ball 42 in bore 72 of rifle 70.

In operation, the following steps are performed in the sequence indicated. First, the device 10 is prepared for loading. Slide cover strip 48 is forced as far forward as possible, by pushing tab 50 as far from backstop 52 as possible. Hasp 38 is lifted and upper plunger housing 24 rotated backwardly on hinge 30 after plunger 20 is raised sufficiently to permit such pivotal motion. A premeasured charge of powder 29 and the ball 42 are inserted into bore 28. Upper plunger housing 24 is then pivoted on hinge 30 and hasp 38 is closed on staple 40. Pressure on handle 16 forces plunger 20 downwardly, in order to force ball 42 and the premeasured amount of black powder 29 into contact with slide cover strip 48, pressure sufficient to keep cover strip 48 closed is applied. The device can be carried in this loaded configuration until reloading of the muzzle loaded rifle becomes necessary. Preferably, percussion cap 59 is placed in leather extension 58 for convenient access when reloading becomes necessary.

Figure 5:
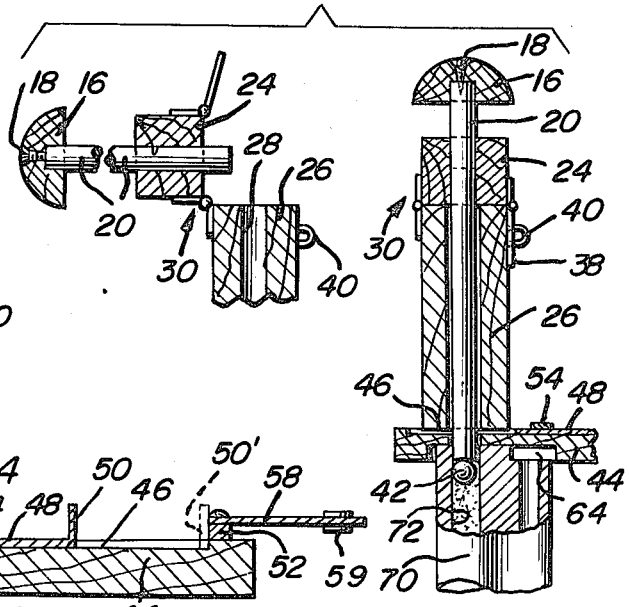
FIG. 5 is a group sectional view of the device in two phases of operation, the fragmentary representation to the left showing the device opened for insertion of a ball, powder and starter, and the fragmentary representation at the right showing the device engaged with the barrel of a muzzle loaded rifle.

At the time when use of the device is desired, such as after firing of the muzzle loaded rifle, the device is placed over the barrel of the rifle in the manner shown in the representation at the right of FIG. 5, slide cover strip 48 is manually extended by rightward pushing of tab 50, thereby permitting deposition of the contents of longitudinal bore 28 through platform bore 60 and into rifle bore 72 by downward sliding of plunger 20 through manual action on handle 16. With ball 42 and associated charger powder 29 deposited into bore 72 of rifle 70, ball 42 is seated therein and a conventional ramrod is used in a conventional manner to push ball 42 and associated powder charge to the proper firing position. Cap 59 is then placed on the nipple of the firing mechanism while the rifle is aligned for a second shot. The entire reloading process is expedited to the extent of requiring only a few seconds. With use of conventional reloading equipment, including a powder container from which the powder must be measured, a separate container for ball 42 and yet a different container for the cap, it typically requires one to two minutes to reload and if one of the necessary containers is misplaced, the period for reloading can be considerably greater.

The device of the present invention can be adapted to fit almost any known construction of muzzle loading rifle, including rifles conventionally constructed with caliber from 36 to 58. The device can be adapted to a variety of balls, including types known as "Minie" or "Maxie", and a patched round ball can also be used, such as with a polyolefin patch.

It is important that parts of the invention coming in contact with black powder be constructed of materials which do not cause a spark when in contact with each other or with the portion of rifle 70 contacting device 10. Accordingly, slide cover strip 48 is preferably made of a metallic material such as brass which does not generate sparks or cause ignition of black powder when struck by other metals. In this regard, an iron or steel alloy would be particularly unsuitable for slide cover strip 48, as well as for plunger 20, platform 44, or plunger housings 24 and 26. Subject to these limitations, however, many materials can be substituted for the materials described, with it being understood that a principal advantage of the device 10 resides in its portability and ease of transporting under field conditions. Accordingly, wooden components are preferred for handle 16, plunger 20, platform 44, backstop 52 and housings 24 and 26. When platform 44 is made of wood, trough 46 can be hand carved thereinto, or it can be fashioned by other suitable techniques.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Apparatus for loading a premeasured charge of propellant and a ball in a muzzle loaded firearm, the apparatus comprising a plunger assembly for receiving said charge and said ball, and a mounting and loading assembly attached to the plunger assembly for mounting on the muzzle loaded firearm and depositing said charge and said ball thereinto, said firearm being a rifle, said porpellant being black powder, and said plunger assembly comprising a plunger slidingly contained within a plunger housing, the mounting and loading assembly comprising a platform having release means for acting in cooperation with said plunger to deposit said charge and said ball into said rifle and having a recess for conformingly mounting the apparatus on the barrel of said rifle held in an upright position, said plunger housing comprising an elongated block having a longitudinal bore, said plunger having a handle for manual sliding extension and retraction of the plunger within said longitudinal bore, said platform having a platform bore in register with said longitudinal bore, and said release means separating said longitudinal bore from said platform bore, said platform having a trough extending through said platform bore, said release means comprising a slide cover strip slidable within said trough to separate and close off said longitudinal bore from said platform bore, said apparatus further including holding means for releasably holding a percussion cap for use with said rifle.

2. The apparatus of claim 1 wherein said plunger housing has an upper portion and a lower portion attached thereto by pivot means, the upper portion being pivotable about said pivot means to permit loading of said charge and said ball into said longitudinal bore in said lower portion of the plunger housing.

3. The apparatus of claim 2 wherein said pivot means comprises a hinge, and an opposably situated hinge type hasp permits releasable securing of said upper plunger housing to said lower plunger housing.

4. The apparatus of claim 3 wherein said slide cover strip at the end remote from said platform bore has a tab for manual sliding within said trough, said trough having a backstop for limiting the extension of said slide cover strip in the direction away from said platform bore.

5. The apparatus of claim 4 wherein said holding means comprises a leather extension attached to said backstop, said backstop, platform, plunger, handle and plunger housing being made of wood, said backstop being attached to said platform, said upper plunger housing and said cover plunger housing being attached to said hinge, said lower plunger housing being attached to said platform, and said handle being attached to said plunger by a wood screw.

6. A method for operation of the apparatus of claim 5 comprising the following steps:

(a) manually pushing said tab in the direction of said bore to close off said platform bore from said longitudinal bore;

(b) retracting said plunger in said longitudinal bore and releasing said hasp to permit pivotal motion of said hinge of said upper plunger housing, and pivoting the upper plunger housing backwardly and downwardly;

(c) placing said premeasured charge and said ball into the longitudinal bore of said lower plunger housing;

(d) pivotally moving said upper plunger housing upwardly and forwardly and securing said hasp to bring the longitudinal bore to said upper plunger housing and said lower plunger housing in register;

(e) extending said plunger by manual application of force to said handle to move downwardly and then place sufficient pressure on said ball and charge so as to retain said slide cover strip in the closed position until further use is desired;

(f) when loading of the rifle is desired, mounting said recess of said platform over the upright barrel of said rifle;

(g) manually sliding said slide cover strip toward said backstop;

(h) manually extending said plunger downwardly to deposit said charge and ball into said rifle and to seat said ball in the barrel of the rifle; and (i) releasing said cap from said leather extension for use with the rifle.

7. Apparatus for loading a premeasured charge of propellant and a ball in a muzzle loaded firearm, the apparatus comprising a housing containing a longitudinal bore for receiving said charge and said ball, a plunger having a handle for manual sliding extension and retraction of the plunger within said longitudinal bore, a mounting and loading assembly attached to said housing for mounting on the muzzle loaded firearm and depositing said charge and said ball thereinto, said mounting and loading assembly comprising a platform having a platform bore in register with said longitudinal bore, and release means comprising a strip slidable across the longitudinal bore to separate and close off said longitudinal bore from said platform bore, said platform further including a recess for conformingly mounting the apparatus on the barrel of said firearm.

8. The apparatus of claim 7 wherein said platform has a trough extending through said platform bore, said strip comprising a slide cover strip slidable within said trough to separate said longitudinal bore from said platform bore.

9. The apparatus of claim 8 wherein said slide cover strip at an end remote from said platform bore has a tab for manual sliding within said trough, said trough having a back stop for limiting the extension of said slide cover strip in the direction away from said platform bore.

10. The apparatus of claim 9 including holding means for releasably holding a percussion cap for use with said firearms.

* * * * *